US006371786B1

(12) United States Patent
Howell et al.

(10) Patent No.: US 6,371,786 B1
(45) Date of Patent: Apr. 16, 2002

(54) ZIF SOCKET WITH A CAM LEVER LATCH

(75) Inventors: David G. Howell, Gilbert, AZ (US); Fang-Chu Liao; Chaw Cheng Cheng, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/880,235

(22) Filed: Jun. 12, 2001

(51) Int. Cl.[7] ..... H01R 13/625
(52) U.S. Cl. ..... 439/342; 439/353
(58) Field of Search ..... 439/342, 70, 259, 439/266, 345, 352, 353

(56) References Cited

U.S. PATENT DOCUMENTS 5,679,020 A * 10/1997 Lai et al. ..... 439/342
5,697,803 A * 12/1997 Kistner et al. ..... 439/342
5,947,778 A * 9/1999 Lai et al. ..... 439/876
6,042,413 A * 3/2000 Hsiao et al. ..... 439/342
6,243,267 B1 * 6/2001 Chuang et al. ..... 361/704

* cited by examiner

*Primary Examiner*—Tulsidas Patel
(74) *Attorney, Agent, or Firm*—Wei Te Chung

(57) ABSTRACT

A ZIF socket (1) comprises a base (10), a sliding cover (20), a cam lever (30) and a plurality of terminals (40) received in the base. The base comprises a block (16) extending outwardly from a rear end thereof. The sliding cover is movably assembled on the base. The cam lever comprises an actuating rod (31) and a handle (32) extending perpendicularly from an end of the actuating rod. The actuating rod is rotatably assembled between the base and the sliding cover and drives the sliding cover to move relative to the base. An integral latch (50) is provided in front of the block and comprises a lower bridge (51) extending forwardly from a bottom end of the block. A spring arm (52) extends from front end of the lower bridge and a contact portion (53) extends from an end of the spring arm for contacting with the handle before the handle arrives at an open position.

9 Claims, 6 Drawing Sheets

ZIF SOCKET WITH A CAM LEVER LATCH

BACKGROUND OF THE INVENTION

1. Field of the Invention

The present invention relates to a ZIF socket, and particularly to a ZIF socket with a cam lever latch for protecting a handle of the socket from being unduly manipulated.

2. Description of Related Art

A low-profile ZIF socket is widely used for electrically connecting an integrated circuit chip with a printed circuit board for its convenient manipulation. Referring to FIG. 6, a conventional low-profile ZIF socket 6 comprises a base 7, a sliding cover 8, a plurality of terminals 60 and a cam lever 9. The base 7 comprises a lower rectangular member 71 and a mounting portion 72 in a rear end of the rectangular member 71. The lower rectangular member 71 defines a plurality of receiving passageways 73 for receiving corresponding terminals 60. The mounting portion 72 comprises a lower transverse receiving channel 74 and a block 75 extending outwardly from a rear and right end of the mounting portion 72 for preventing the cam lever 9 from moving over an open position. The sliding cover 8 is movably assembled on the base 7 and comprises n upper rectangular member 81 and a tailboard 82 in a rear end of the upper rectangular member 81. The upper rectangular member 81 defines a plurality of through holes 83 in vertical alignment with corresponding receiving passageways 73 of the lower rectangular member 71 for receiving pins of an integrated circuit chip (not shown). The tail board 82 comprises upper transverse receiving channel 84. The cam lever 9 is substantially an L-shaped rod and comprises a straight handle 91 and an actuating arm 92 perpendicular to the handle 91. The actuating arm 92 is rotatably retained between the lower receiving channel 74 and tail board 82, and includes a curved arm 93 extending forwardly in a middle thereof which rotates in the upper receiving channel 84 for carrying the sliding cover 8 to move relative to the base 7, whereby the pins of the integrated circuit chip may connect with or disconnect with the corresponding terminals 60 of ZIF socket 6.

However, referring to FIG. 7, when the handle 91 is rotated from a closed position to the open position, it hits the block 75 directly. Therefore, when the handle 91 is over-rotated, the handle 91 or the block 75 of the base 7 will be broken. U.S. Pat. No. 5,722,848 (the '848 patent) having the same assignee discloses a retention mechanism between the block and the handle (FIGS. 7 and 7(A) of the '848 patent), while such a design still has the similar direct hitting problem as the design in FIG. 7 of the invention.

Hence, an improved cam lever arrangement is required to overcome the disadvantages of the conventional ZIF socket.

SUMMARY OF THE INVENTION

Accordingly, one object o the present invention is to provide a ZIF socket with a latch for informing the arrival at a open position of a cam lever.

Another object of the preset invention is to provide a ZIF socket with a latch for retaining the cam lever n the open position.

In order to achieve the objects set forth, a ZIF socket for retaining an integrated circuit chip with a plurality of pins thereon comprises a base, a sliding cover, a cam lever and a plurality of terminus. The base comprises a lower rectangular member and a cam journal section in a rear end of the rectangular member. The rectangular member includes a plurality of receiving passageways for receiving corresponding terminals. The cam journal section comprises a block extending outwardly from a transverse end thereof. The sliding cover is movably assembled on the base and includes an upper rectangular member and a shroud section in a rear end of the upper rectangular member. The upper rectangular member defines a plurality of through holes for receiving corresponding pins of the integrated circuit board. The cam lever comprises an actuating rod and a handle extending perpendicularly from an end of the actuating rod. The actuating rod is rotatably assembled between the cam journal section and the shroud and drives the sliding cover to move relative to the base. An integral latch is provided in front of the block and comprises a lower bridge extending forwardly from a bottom end of the block. A spring arm extends from a front end of the lower bridge and a contact portion extends from an upper end of the spring arm for contacting with the candle before the handle arriving at an open position. In the open position, the handle is beneath the contact portion and prevented from moving to a closed position.

Other objects, advantages and novel features of the invention will become more apparent from the following detailed description when taken in conjunction with the accompanying drawings.

DETAILED DESCRIPTION OF THE INVENTION

Figure 1:
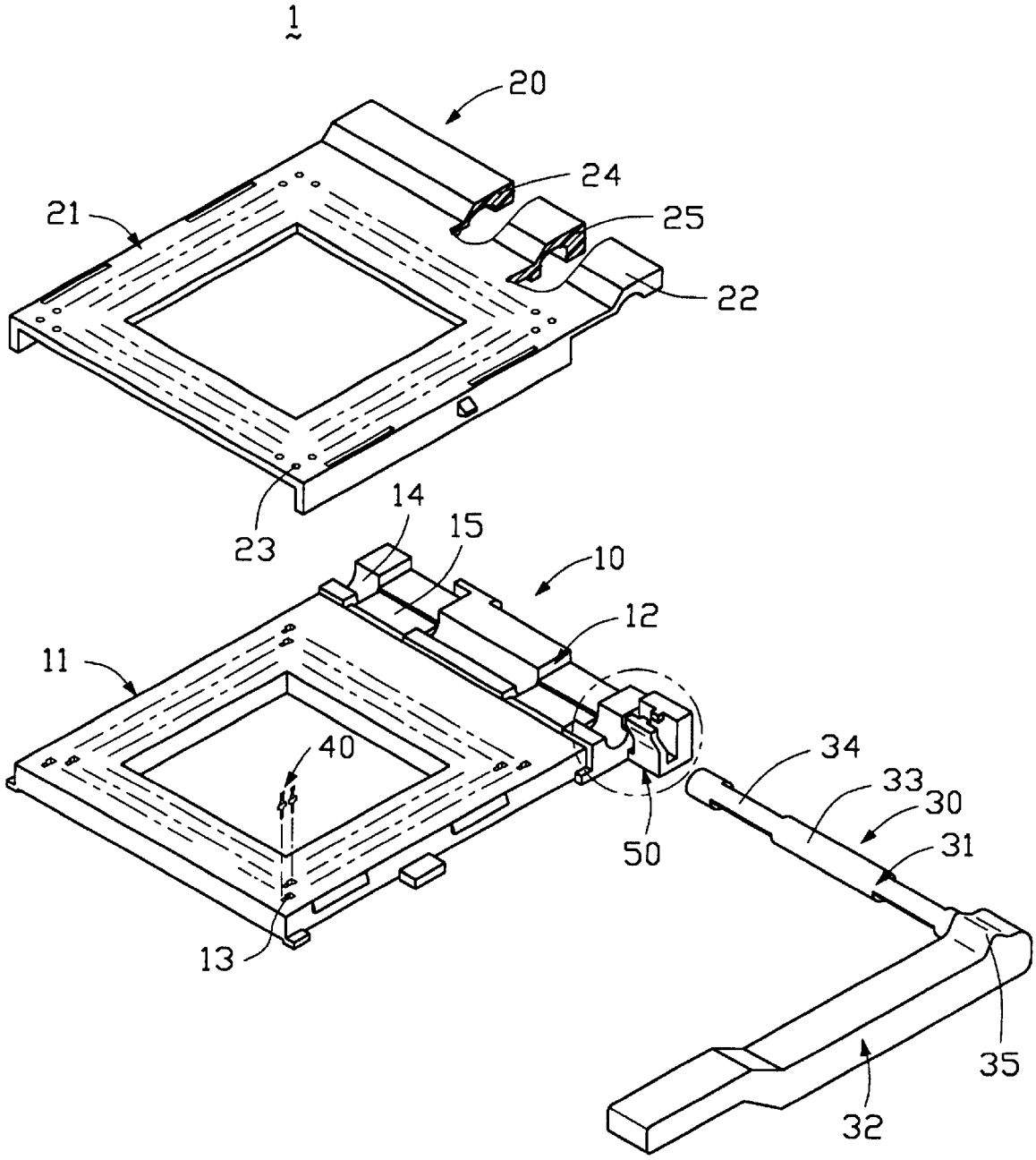
FIG. 1 is a perspective exploded view of a ZIF socket with a latch of the present invention.

Reference will now be made to the drawing figures to describe the present invention in detail.

Figure 2:
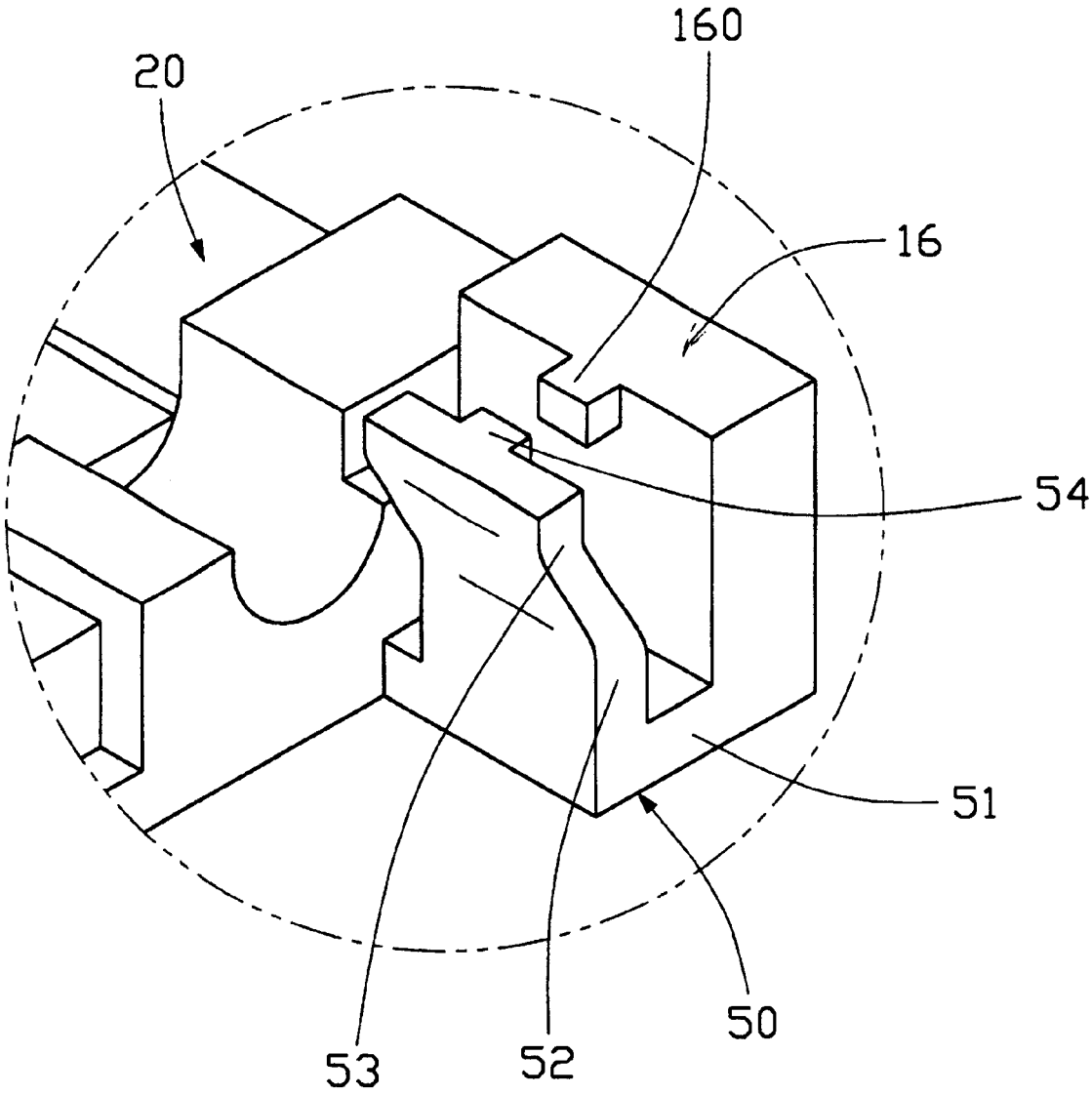
FIG. 2 is an enlarged perspective view of the latch of FIG. 1.

Referring to FIG. 1 and FIG. 2, a ZIF socket 1 of the present invention comprises a base 10, a sliding cover 20, an cam lever 30 and a plurality of terminals 40.

The base 10 comprises a lower rectangular member 11 and a cam journal section 12 in a rear end thereof. The lower rectangular member 11 comprises a plurality of spaced apart cavities 13 extending vertically through the base 10 for receiving corresponding terminals 40. The cam journal section 12 includes three spaced apart lower bearing portions 14 and two lower operation portions 15 each disposed between two spaced bearing potions 14. The cam journal section 12 comprises a block 16 extending from a right and rear end thereof for preventing the cam lever 30 from moving unduly in an open position. The block 16 comprises a rear protrusion 160 extending forwardly from a top thereof. A latch 50 is provided in front of the block 16 and comprises a lower bridge 51 extending forwardly from a bottom of the block 16, a spring arm 52 extending upwardly from a front end of the lower bridge 51 and a contact portion 53 extending slantways forwardly from an upper end of the spring arm 52. A front protrusion 54 extends rearwardly from a top of the contact portion 53 in horizontal alignment with the rear protrusion 160. As shown in this preferred embodiment of the present invention, the latch 50 is integrally formed with the block 16. However, it should be understood that the latch 50 can also be formed as a separate part, which is within the skill of an ordinary artisan.

Similar to the base 10, the sliding cover 20 includes an upper rectangula member 21 and a shroud section 22 in a rear end thereof. The upper rectangular member 21 includes a plurality of through holes 23 in alignment with corresponding cavities 13 of the base 10 for receiving corresponding pins of a mating integrated circuit chip (not shown). The shroud section 22 includes three transverse speed apart upper bearing portions 24 in vertical alignment with corresponding lower bearing portions 14 and two spaced upper operation sections 25 each disposes between two adjacent upper bearing portions 24.

The cam lever 30 is substantially L-shaped and includes an actuating rod 31 pivotably sandwiched between the cam journal section 12 and the shroud section 22. The actuating rod 31 includes three spaced round coaxial pivots 33 and two cams 34 each disposed between two adjacent pivots 33. A manual handle 32 extends perpendicularly from an end of the actuating rod 31. The handle 32 includes a projection 35 extending upwardly from a rear end thereof.

Figure 3:
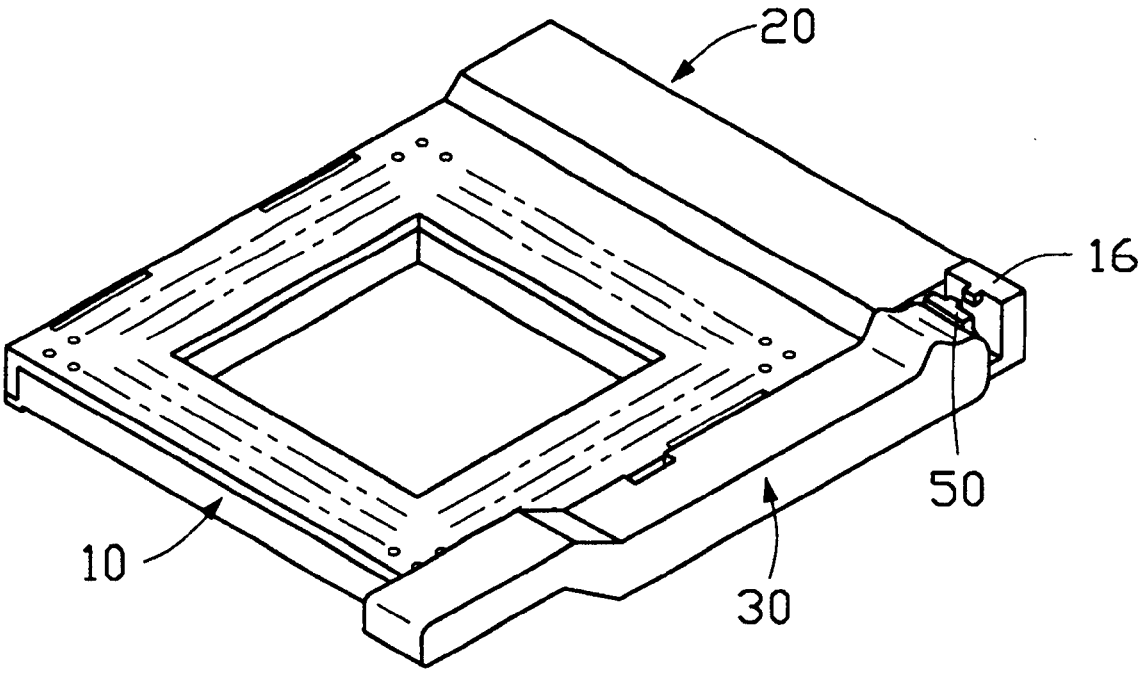
FIG. 3 is a perspective view of the assembled ZIF socket.

Referring to FIG. 3, in assembly, after the actuating rod 31 of the cam lever 30 is placed on the cam journal section 12 with the pivots 33 received in corresponding lower bearing portions 14, the sliding cover 20 is movably assembled on the base 10. Therefore, the actuating rod 31 is pivotably sandwiched between the cam journal section 12 and the shroud section 22.

Figure 4:
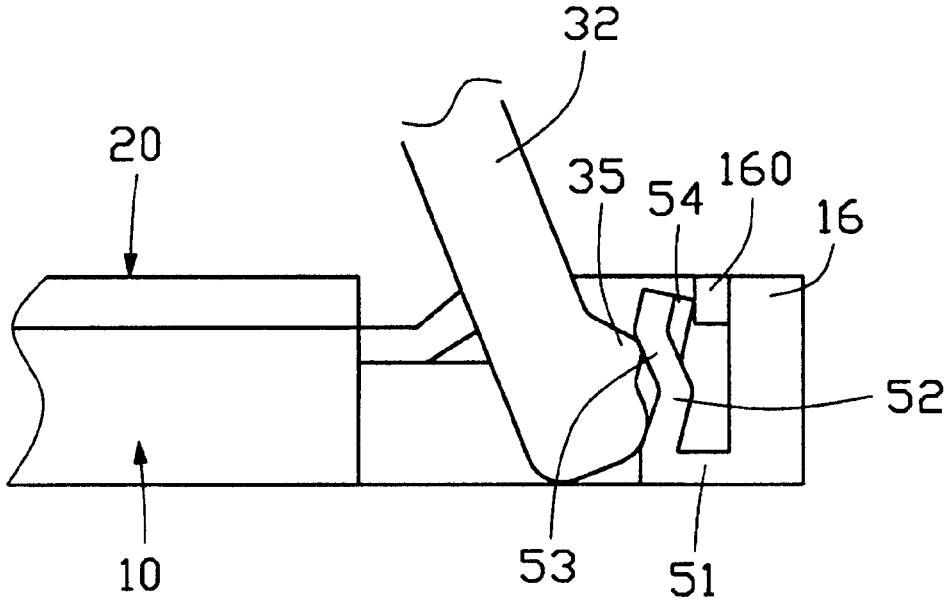
FIG. 4 is an enlarged plan view of the latch being pressed by a handle of the invention and before reaching an open position.
Figure 5:
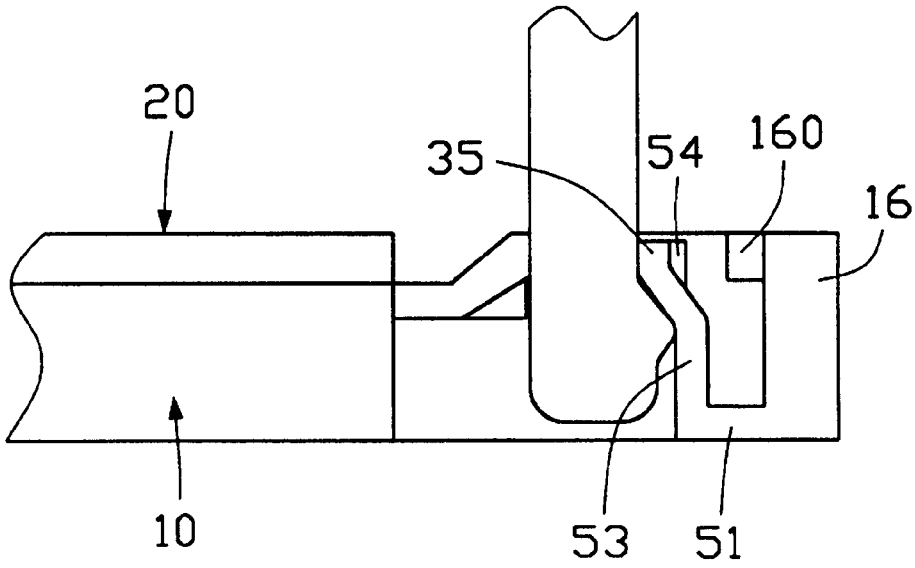
FIG. 5 is an enlarged plan vie of the latch wherein the handle is in the open position.
Figure 6:
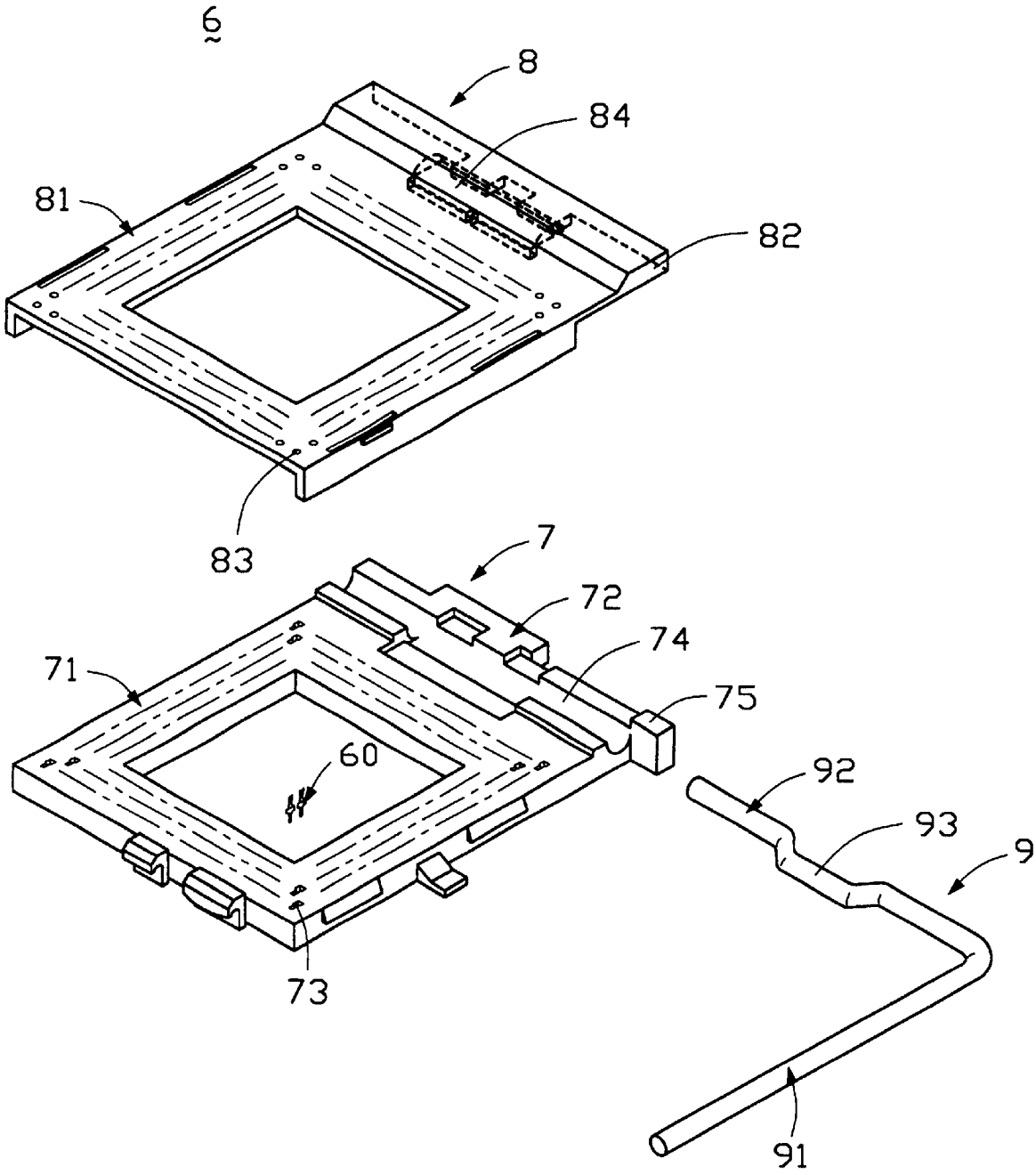
FIG. 6 (PRIOR ART)
FIG. 6 is a perspective exploded view of a conventional ZIF socket.
Figure 7:
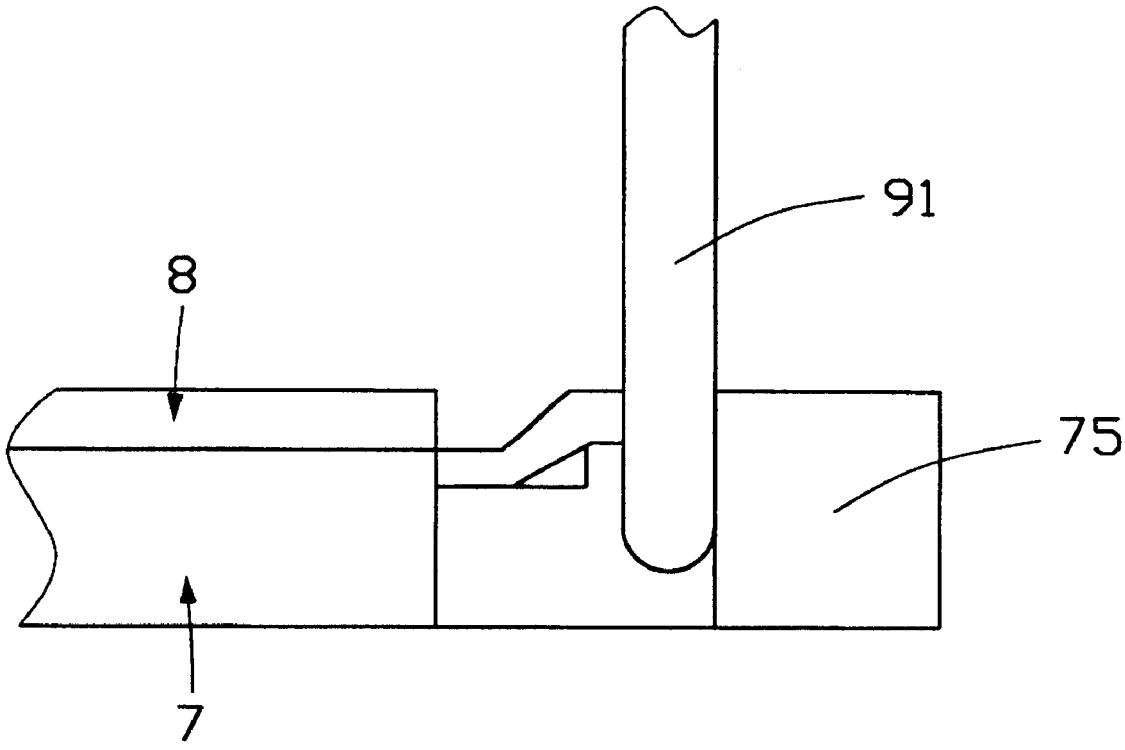
FIG. 7 (PRIOR ART)
FIG. 7 is an enlarged plan view of the ZIF socket of FIG. 6 wherein a rod is in an open position.

Referring to FIG. 4 and FIG. 5, when the handle 32 is rotated from a closed position to an open position, the projection 35 of the handle 32 will contact with the contact potion 53 of the latch 50 at first before the handle 32 arrive at the open position. The spring arm 52 is pressed by the projection 35 and resiliently bends rearwardly from a non-deformation position. After the projection 35 of the handle 32 is pushed under the contact portion 53, the spring arm 52 restores to the non-deformation position. The handle 32 is subjected to the force between the contact portion 53 and the projection 35 before it reaches the open position. This provides a sensible indication about the arrival of the handle 32 at the open position. Therefore, the cam lever 30 and the base 10 can be protected from being broken by undue manipulation. To say the least, even if the handle 32 brought an undue force on the latch, the front protrusion 54 of the latch 50 would engage with the rear protrusion 160 of the block 16 for preventing the spring arm 52 of the latch 50 from bending unduly and being broken. In addition, the projection 35 of the handle 32 is beneath the contact portion 53 of the latch 50 in the open position so that the handle 32 is prevented from moving to the closed position.

It is noted that the invention provides a cantilever type spring arm 52 cooperating with the projection 35 of the handle 32 to result in a elastic/soft stop/resistance at the eve of reaching the open position of the handle 32, and further provides solid stop between the block 16 and the latch 50, when the spring arm 52 is experienced to be significantly deflected rearwardly, for preventing over-rotation of the handle 32. Additionally, the projection 35 cooperates with the contact portion 53 to retain the handle 32 in the open position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ZIF socket for retaining an integrated circuit chip with a plurality of pins thereon, comprising:

a plurality of terminals;

a base comprising a lower rectangular member and a cam journal section in a rear end of the rectangular member, the rectangular member including a plurality of receiving passageways for receiving corresponding terminals, the cam journal section comprising a block extending outwardly from a transverse end thereof;

a sliding cover being movably assembled on the base and including an upper rectangular member and a shroud section, the upper rectangular member defining a plurality of through holes for receiving corresponding pins of the integrated circuit chip;

a cam lever comprising an actuating rod and a handle connected to the actuating rod, the actuating rod being rotatably assembled between the cam journal section and the shroud and driving the sliding cover to move relative to the base; and a latch being disposed in front of the block and comprising a spring arm spaced a distance from the block, said spring arm being deflected by the handle before the handle arrives at an open position.

2. The ZIF socket as described in claim 1, wherein the latch is integral with the block.

3. The ZIF socket as described in claim 1, wherein the latch comprises a lower bridge extending forwardly from a bottom of the block to connect with the spring arm and a contact portion extending slantways forwardly from an upper end of the spring arm for contacting with the handle before the handle arrives at an open position.

4. The ZIF socket as described in claim 1, wherein the handle comprises a projection extending outwardly from a rear end thereof for engaging with the spring arm of the latch.

5. A ZIF socket for retaining an integrated circuit chip, comprising:

a base;

a cover slidably mounted on the base;

a plurality of terminals disposed in the base;

a block formed at transverse end of the base;

a cantilever spring arm spaced away from the block with a distance;

a cam lever having an actuating rod to move the cover relative to the base, and a handle connected to one end of said actuating rod and rotatable relative to the base in a vertical plane of said socket along a front-to-back direction; and a projection formed on the handle adjacent to the actuating rod; wherein said spring arm is rearwardly resiliently deflected by said projection during the eve before the handle reaches an open position.

6. The socket as described in claim 5, wherein the spring arm includes a curved contact portion to cooperate with the projection for retaining the handle in the open position.

7. The socket as described in claim 5, wherein the distance between the spring arm and the block is dimensioned to have the block provide a solid stop against the spring arm when said spring arm is significantly over-deflected by over-rotation of the handle with over 90 degrees.

8. The socket as described in claim 7, wherein at least one of said spring arm and said block includes a protrusion toward the other.

9. A ZIF socket for retaining an integrated circuit chip with a plurality of pins thereon, comprising:

a plurality of terminals;

a base comprising a lower rectangular member and a cam journal section in a rear end of the rectangular member, the rectangular member including a plurality of receiving passageways for receiving corresponding terminals, the cam journal section comprising a block extending outwardly from a transverse end thereof;

a sliding cover being movably assembled on the base and including an upper rectangular member and a shroud section, the upper rectangular member defining a plurality of through holes for receiving corresponding pins of the integrated circuit chip;

a cam lever comprising an actuating rod and a handle connected to the actuating rod, the actuating rod being rotatably assembled between the cam journal section and the shroud section and driving the sliding cover to move relative to the base; and a latch disposed in front of the block for pressing the handle before the handle arrives at an open position; wherein the latch comprises a front protrusion extending rearwardly from an upper end thereof, and the block comprises a rear protrusion extending forwardly from an upper end thereof and pressing against the front protrusion for preventing the latch from bending unduly.

* * * * *